US010214376B2

(12) United States Patent
Chang et al.

(10) Patent No.: US 10,214,376 B2
(45) Date of Patent: Feb. 26, 2019

(54) SHEET MEDIUM FLATTENING DEVICE AND FINANCIAL SELF-SERVICE DEVICE

(71) Applicant: GRG BANKING EQUIPMENT CO., LTD., Guangzhou, Guangdong (CN)

(72) Inventors: Yang Chang, Guangdong (CN); Yin Xia, Guangdong (CN); Zhiwen Jiang, Guangdong (CN); Zhuang Jiang, Guangdong (CN); Hongjun Wu, Guangdong (CN); Zhiqiang Sun, Guangdong (CN); Dong Tan, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/775,838

(22) PCT Filed: May 5, 2016

(86) PCT No.: PCT/CN2016/081154
§ 371 (c)(1),
(2) Date: May 14, 2018

(87) PCT Pub. No.: WO2017/088353
PCT Pub. Date: Jun. 1, 2017

(65) Prior Publication Data

US 2018/0327211 A1 Nov. 15, 2018

(30) Foreign Application Priority Data

Nov. 23, 2015 (CN) ..... 2015 1 0822618

(51) Int. Cl.
*B65H 23/34* (2006.01)
*B65H 29/62* (2006.01)
(Continued)

(52) U.S. Cl.
CPC ..... *B65H 23/34* (2013.01); *B65H 29/62* (2013.01); *B65H 43/04* (2013.01); *G07D 13/00* (2013.01);
(Continued)

(58) Field of Classification Search
CPC .. B65H 29/62; B65H 43/04; B65H 2404/632; B65H 2404/1531; B65H 23/34; B65H 2301/51256; G07D 13/00; G07F 19/202
See application file for complete search history.

(56) References Cited

U.S. PATENT DOCUMENTS 8,215,636 B2 * 7/2012 Youn ..... B65H 5/062 271/162
2008/0166164 A1 * 7/2008 Park ..... B65H 5/062 399/397
(Continued)

FOREIGN PATENT DOCUMENTS

CN 1409271 A 4/2003
CN 2624895 Y 7/2004
(Continued)

OTHER PUBLICATIONS

International Search Report for PCT/CN2016/081154 dated Aug. 16, 2016, ISA/CN.
(Continued)

*Primary Examiner* — Patrick Cicchino
(74) *Attorney, Agent, or Firm* — U.S. Fairsky LLP; Yue (Robert) Xu

(57) ABSTRACT

A sheet medium flattening device includes a mounting frame configured to mount and support following components; an annular passage, including an annular inner passage plate and an annular outer passage plate, a heating module arranged in a hollow inner cavity of the inner passage plate to supply heat for the inner passage plate; at least one pinch
(Continued)

roller arranged at an outer side of the annular guiding plate and realizing clamping with the inner passage plate through a hole slot arranged in the annular guiding plate; a reversing mechanism configured to selectively convey banknotes between the conveying passage and the annular passage of the flattening device; a driving device configured to drive the inner passage plate to rotate; and a control system configured to control a temperature of the heating module and control a selectively switchover of the reversing mechanism.

16 Claims, 7 Drawing Sheets

(51) Int. Cl.

| | |
|---|---|
| ***B65H 43/04*** | (2006.01) |
| ***G07F 19/00*** | (2006.01) |
| ***G07D 13/00*** | (2006.01) |

(52) U.S. Cl.

CPC ..... *G07F 19/202* (2013.01); *B65H 2301/314* (2013.01); *B65H 2301/51256* (2013.01); *B65H 2404/1531* (2013.01); *B65H 2404/632* (2013.01); *B65H 2515/842* (2013.01)

(56) References Cited

U.S. PATENT DOCUMENTS

| | | | | |
|---|---|---|---|---|
| 2011/0061987 | A1 | 3/2011 | Seki et al. | |
| 2014/0251752 | A1* | 9/2014 | Cha ..... | B65H 5/06 194/344 |

FOREIGN PATENT DOCUMENTS

| | | | |
|---|---|---|---|
| CN | 2755687 | Y | 2/2006 |
| CN | 102842170 | A | 12/2012 |
| CN | 103985188 | | 8/2014 |
| CN | 104112312 | A | 10/2014 |
| CN | 104444519 | A | 3/2015 |
| CN | 104616394 | A | 5/2015 |
| CN | 105303693 | A | 2/2016 |
| EP | 2079041 | A1 | 7/2009 |
| EP | 2495202 | A2 | 9/2012 |
| JP | 2000268227 | A | 9/2000 |

OTHER PUBLICATIONS

Search report dated Dec. 10, 2018 for European patent application No. 16867582.5, 6 pages.

* cited by examiner

SHEET MEDIUM FLATTENING DEVICE AND FINANCIAL SELF-SERVICE DEVICE

This application is the national phase of International Application No. PCT/CN2016/081154, titled "SHEET MEDIUM FLATTENING DEVICE AND FINANCIAL SELF-SERVICE DEVICE", filed on May 5, 2016, which claims the priority to Chinese Patent Application No. 201510822618.0 titled "SHEET MEDIUM FLATTENING DEVICE AND FINANCIAL SELF-SERVICE DEVICE", filed with the Chinese State Intellectual Property Office on Nov. 23, 2015, the entire disclosures thereof are incorporated herein by reference.

FIELD

The present application relates to a sheet-like medium processing technology, and particularly relates to a flattening device used in a financial self-service equipment to effectively flatten curled banknotes.

BACKGROUND

At present, banknote boxes in financial self-service equipment (such as ATM) can be classified into stack-type banknote storage boxes and drum-type banknote storage boxes according to different ways in which banknotes enter and leave the banknote boxes. Drum-type banknote storage boxes have been applied in circulatory machine cores due to its advantages such as having a small occupation volume, a high reliability of banknotes entering and leaving, and a considerable amount of banknotes deposit and so on. The depositing of banknotes in the drum-type machine core is completed by a reel and a tape, and the banknotes are guided by the tape to wrap around the reel layer upon layer. When the banknotes are discharged, the tape rotates reversely to guide the banknotes to be released from the reel.

When the financial self-service equipment is used less frequently, the banknotes may appear to have a curvature approximate to a diameter of the reel after having been stored in the reel of the drum-type machine core, and especially the banknotes near an inner core of the reel have the largest curvature. Therefore, when discharging and conveying severely curled banknotes, unsmooth conveying and even jamming and tearing of the curled banknotes may easily occur in a passage; besides, curled banknotes are not conducive to a secondary banknote feeding, because ends of the banknotes are apt to be bent which obstructs the banknotes from entering a banknote inlet/outlet, and thus severely affects the reliability of equipment operation and customer experience.

At present, a common method to flatten a banknote is to make the banknote pass through a passage having a bending direction opposite to a direction in which the banknote is bent, to force the banknote to bend and deform reversely, and alleviate a bending and deformation degree of the banknote through time and pressure. However, due to a high transmission speed of banknotes in the financial self-service equipment, the treated banknotes have an unobvious or even no flattening effect; and the efficiency is low, which fails to meet the application requirements of the financial self-service equipment.

SUMMARY

In order to address the technical problem in the conventional technology that curled banknotes cannot be effectively and quickly flattened, a flattening device used to effectively flatten curled banknotes is provided according to the present application, to ensure reliability of the operations such as discharging, conveying and identification of the curled banknotes.

A sheet medium flattening device arranged in a sheet medium conveying passage and configured to flatten an inputted sheet medium is provided according to the present application, and includes:

a mounting frame configured to mount and support following components;

an annular passage, including an annular inner passage plate and an annular outer passage plate, wherein the inner passage plate has a hollow inner cavity, a heating module is arranged in the inner cavity, the heating module is configured to supply heat for the inner passage plate, the outer passage plate is an annular guiding plate surrounding the inner passage plate, and the outer passage plate is provided with a sheet medium entrance abuttingly joined with the sheet medium conveying passage;

at least one pinch roller arranged at an outer side of the annular guiding plate, wherein a hole slot is arranged in the annular guiding plate at a position corresponding to the pinch roller, and the pinch roller realizes clamping with the inner passage plate through the hole slot;

a reversing mechanism arranged at the sheet medium entrance and configured to selectively convey banknotes between the conveying passage and the annular passage of the flattening device;

a driving device configured to drive the inner passage plate to rotate; and a control system configured to control a temperature of the heating module and control a selectively switchover of the reversing mechanism.

Preferably, the heating module includes a heating body holder fixedly sleeved on a shaft, the shaft being relatively fixedly mounted on the mounting frame; and at least one heating piece fixedly arranged on the heating body holder and controlled by the control system to perform a heating operation.

Further, the inner passage plate is rotatably arranged on the shaft by a rolling bearing to wrap and seal the heating piece, and the inner passage plate rotates by receiving power from the driving mechanism through a gear fixedly connected to the inner passage plate.

Preferably, there are twelve heating pieces which uniformly surround the shaft and are fixed on the heating body holder through a limiting piece.

Preferably, there are nine pinch rollers uniformly distributed on an outer surface of the annular guiding plate to surround and compress the inner passage plate.

Preferably, the flattening device further includes a front passage assembly, a lower passage and a rear passage assembly which form transition with the sheet medium conveying passage, the lower passage is arranged directly opposite to the sheet medium entrance of the outer passage plate, and the sheet medium is controlled by the reversing mechanism to be selectively introduced into the annular passage or the lower passage to be conveyed.

Preferably, the front passage assembly includes a front passage plate holder configured to support a front passage plate, and the front passage plate is provided with a sensor for detecting banknotes, a driving shaft for conveying the banknotes, and at least one set of floating pressing rollers corresponding to the driving shaft.

Preferably, the rear passage assembly includes a rear passage plate holder configured to support a rear passage plate, and the rear passage plate is provided with a sensor for detecting banknotes, a driving shaft for conveying the banknotes, and at least one set of floating pressing rollers corresponding to the driving shaft.

A financial self-service equipment is further provided according to the present application, including:

a banknote inlet/outlet configured to deposit and/or withdraw banknotes;

a banknote storage box configured to store and discharge the banknotes;

a banknote conveying passage configured to connect the banknote inlet/outlet and the banknote storage box and to convey the banknotes;

wherein the above-described sheet medium flattening device is arranged in the banknote conveying passage.

Compared with the conventional technology, the flattening device according to the present application has the following advantages:

The sheet medium flattening device conveys and heats curled banknotes in the reversed arc-shaped passage, making the curved banknotes to form reliable reverse bending deformation, to effectively reduce a curling degree of the banknotes, thereby enhancing reliability and stability of the financial self-service equipment in operations like banknotes transmission, identification and stacking. The device is miniaturized, it is not required to make major changes to original financial self-service equipment, and the device can be arranged as a banknote conveying passage in the machine core.

DETAIL DESCRIPTION

In order to further illustrate the application and specific structural configuration and operation process of the flattening device provided by the present application, detailed descriptions are further made hereinafter in conjunction with the drawings of the preferable embodiments according to the present application.

Figure 1:
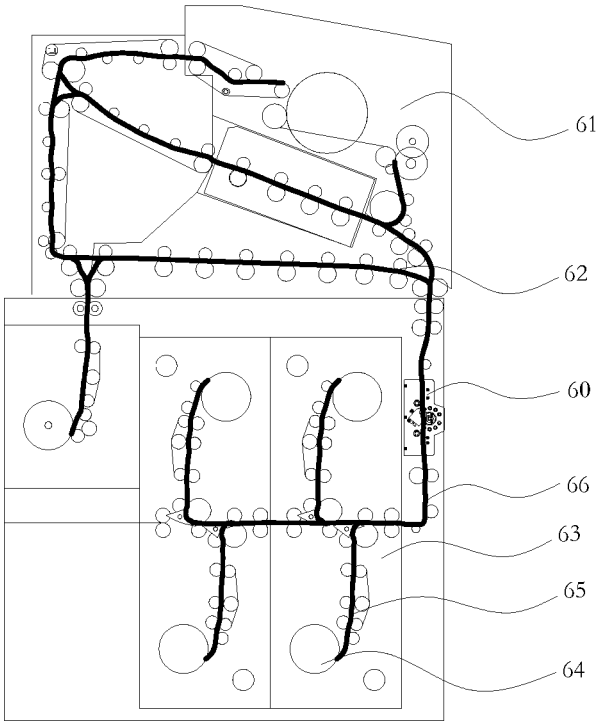
FIG. 1 is a schematic view showing the configuration of a financial self-service equipment according to the present application.
Figure 2:
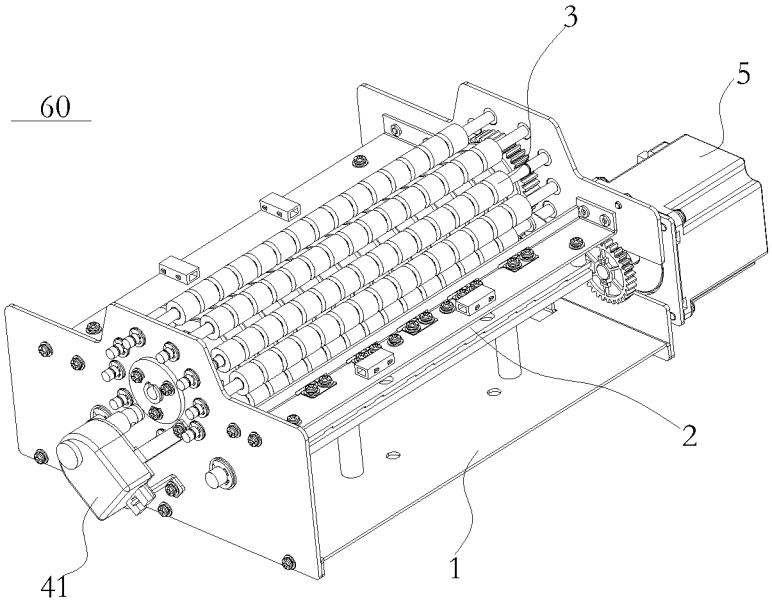
FIG. 2 is a schematic view showing the configuration of a preferable sheet medium flattening device according to the present application.

As shown in FIG. 1, which is a schematic view showing the configuration of a financial self-service equipment provided according to the present application, the financial self-service equipment includes a banknote inlet/outlet 61 for depositing and/or withdrawing banknotes; a banknote conveying passage 62 configured to connect the banknote inlet/outlet 61 and a banknote storage box 63 and to convey banknotes; the banknote storage box 63, including a reel 64 configured to bear the banknotes and at least one tape 65 configured to wind and bundle the banknotes around a periphery of the reel 64. The banknotes are guided by the tape 65 to enter a gap formed between the reel 64 and the tape 65, to be wrapped around the periphery of the reel 64 layer upon layer. When the banknotes are required to be discharged, the tape 65 drives the reel 64 to rotate reversely, the banknotes are guided by the tape 65 and discharged through the banknote conveying passage 62. A sheet medium flattening device 60 is arranged in the banknote conveying passage 62 to flatten the curved banknotes.

The configuration of the sheet medium flattening device 60 is illustrated in detail hereinafter in conjunction with FIGS. 2 to 10.

Figure 3:
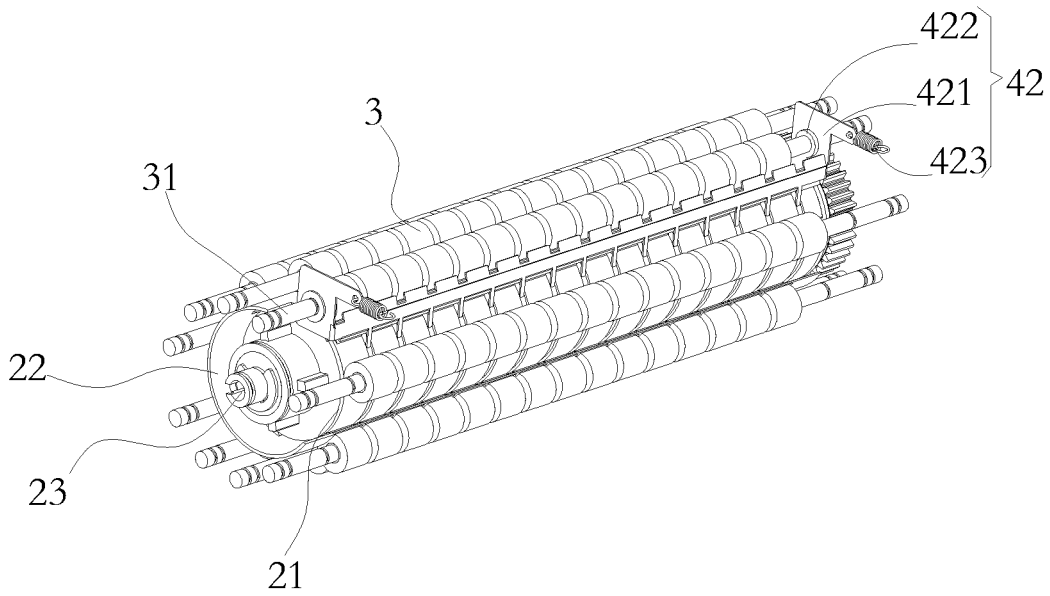
FIG. 3 is a schematic view showing the configuration of an annular passage in FIG. 2.
Figure 4:
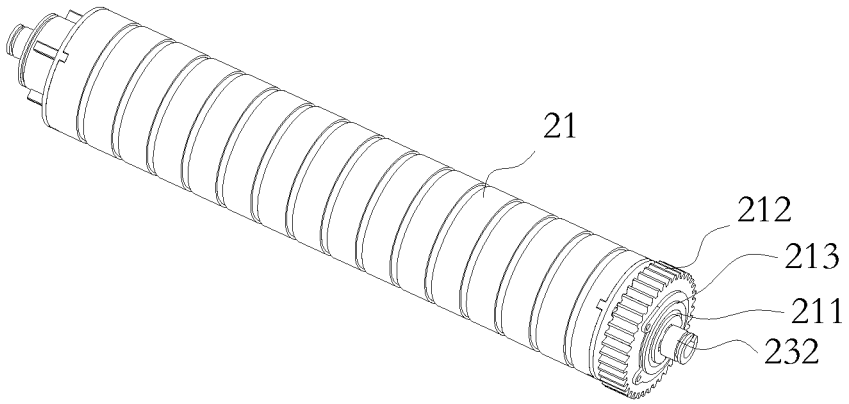
FIG. 4 is a schematic view showing an inner passage plate in FIG. 3.
Figure 5:
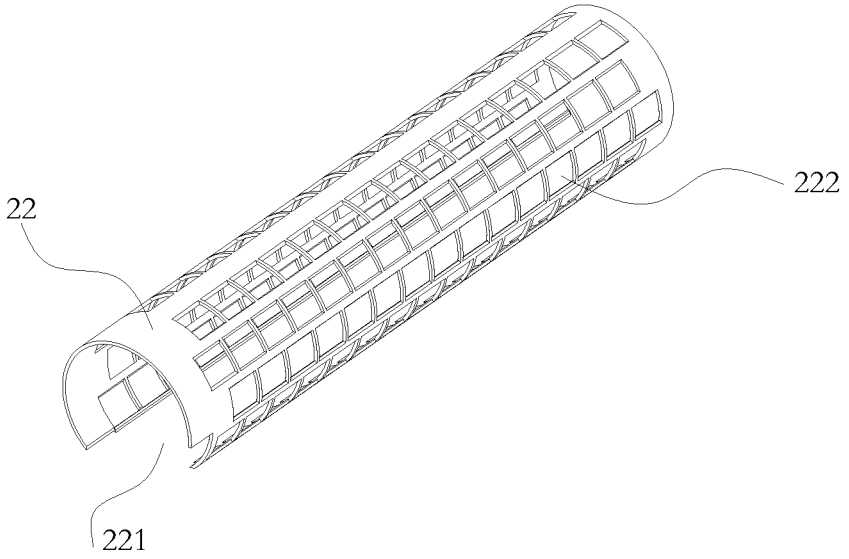
FIG. 5 is a schematic view showing an outer passage plate in FIG. 3.

Referring to FIGS. 2 to 5, which are schematic views of the configuration of a preferable sheet medium flattening device, the sheet medium flattening device includes: a mounting frame 1 configured to mount and support following components; an annular passage 2 including an annular inner passage plate 21 and an annular outer passage plate 22; at least one pinch roller 3; a reversing mechanism 4; a driving device 5 used to drive the inner passage plate to rotate; and a control system (not shown). The inner passage plate 21 has a hollow inner cavity, a heating module 23 is arranged in the inner cavity, and the heating module 23 supplies heat for the inner passage plate 21. The outer passage plate 22 is an annular guiding plate surrounding the inner passage plate 21, and the outer passage plate 22 is provided with a sheet medium entrance 221 abuttingly joined with the sheet medium conveying passage 62. The pinch roller 3 is arranged at an outer side of the annular guiding plate, a hole slot 222 is arranged in the annular guiding plate at a position corresponding to the pinch roller 3, and as shown in FIG. 5, the pinch roller 3 realizes clamping with the inner passage plate 21 through the hole slot 222. Preferably there are 9 pinch rollers 3 uniformly distributed on an outer surface of the annular guiding plate to surround and compress the inner passage plate 21. The reversing mechanism 4 is arranged at the sheet medium entrance 221, to realize selectively conveying of banknotes between the conveying passage 62 and the annular passage 2 of the flattening device. The control system is used for realizing the temperature control of the heating module 23 and the selectively switchover control of the reversing mechanism 4.

Figure 6:
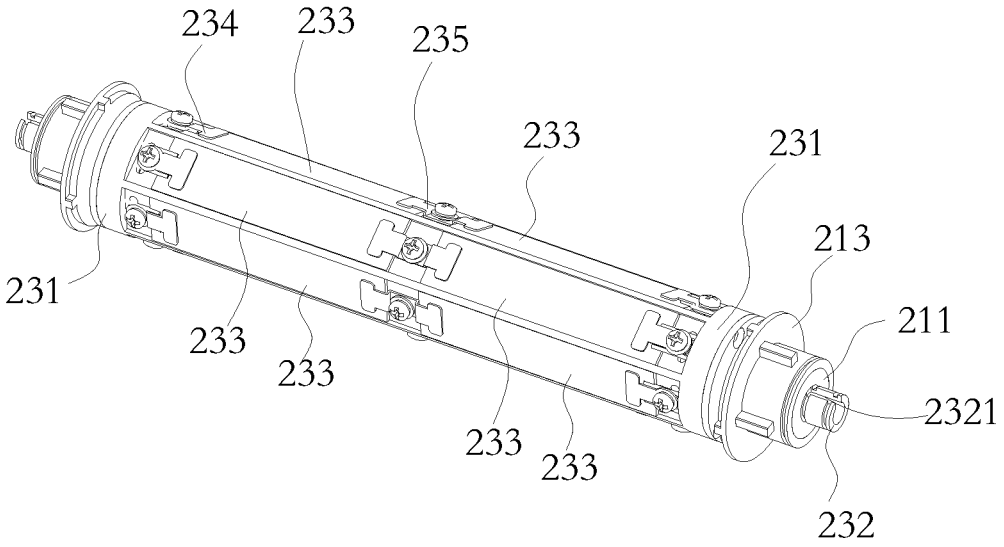
FIG. 6 is a schematic view showing the configuration of a heating module in FIG. 3.

The configuration of the above heating module 23 is illustrated in detail with reference to FIGS. 4 and 6. The heating module 23 includes a heating body holder 231 fixedly sleeved on a shaft 232, and at least one heating piece 233 fixedly arranged on the heating body holder 231 and controlled by the control system to perform heating operation. The shaft 232 is relatively fixedly mounted on the mounting frame 231, notches 2321 are formed on two ends of the shaft 232, and the notches 2321 are assembled with respective limiting buckles 16 fixed on the mounting frame 1 to form limiting structures. In this embodiment, there are twelve heating pieces 233 uniformly surrounding the shaft 232 and fixed on the heating body holder 231 by several limiting pieces, wherein these limiting pieces include twelve lateral limiting pieces 234 and six intermediate limiting pieces 235. The inner passage plate 21 is rotatably arranged on the shaft 232 by a rolling bearing 211, to wrap and seal the heating pieces 233, and the inner passage plate 21 is driven by the driving mechanism 5 through a gear 212 to rotate, and the gear 212 is fixedly connected to the inner passage plate 21. Preferably, the gear 212 is assembled with the bearing 211 through a limiting shaft sleeve 213. In this embodiment, the gear 212 obtains power outputted from the driving device 5 through multiple sets of gears.

Figure 7:
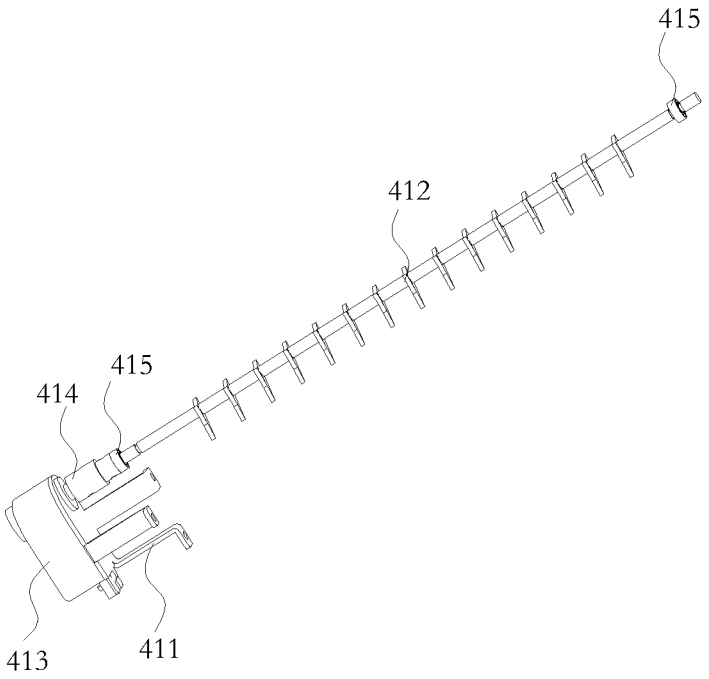
FIG. 7 is a schematic view showing the configuration of a reversing mechanism in FIG. 3.
Figure 11:
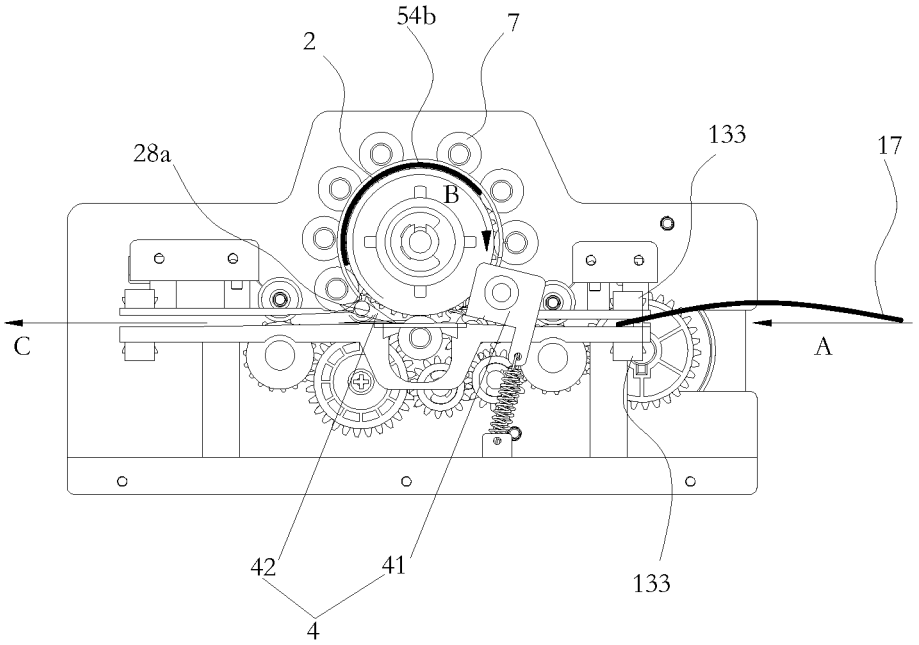
FIG. 11 is a schematic view showing that a curled banknote in FIG. 1 enters the flattening device in FIG. 2.

The reversing mechanism 4 is illustrated with reference to FIGS. 3, 7 and 11. The reversing mechanism 4 includes a lead-in reversing mechanism 41 and a lead-out reversing mechanism 42. The lead-in reversing mechanism 41 includes a fixed bracket 411, and a reversing block 412 rotatably inserted in a reverser 413 through a shaft, and the reverser 413 controls the reversing block 412 to rotate, and the reversing block 412 is assembled with a bearing 415 through a shaft sleeve 414. The lead-out reversing mechanism 42 includes a reversing block 421 which is sleeved on a rotating shaft 31 of a pressing wheel 3 through two bearings 422. The reversing block 421 is pulled by an end of a tension spring 423 (there are two tension springs), another end of the tension spring 423 is fixed on the mounting frame 1, and the reversing block 421 keeps the elastic sealing of the annular passage 2.

Figure 8:
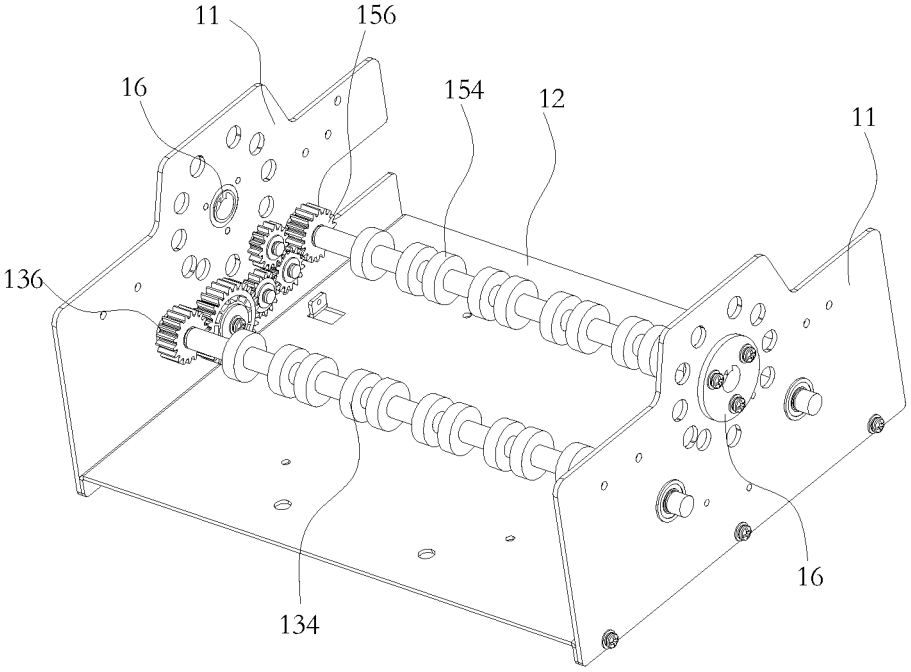
FIG. 8 is a schematic view showing the configuration of a mounting frame in FIG. 2.
Figure 9:
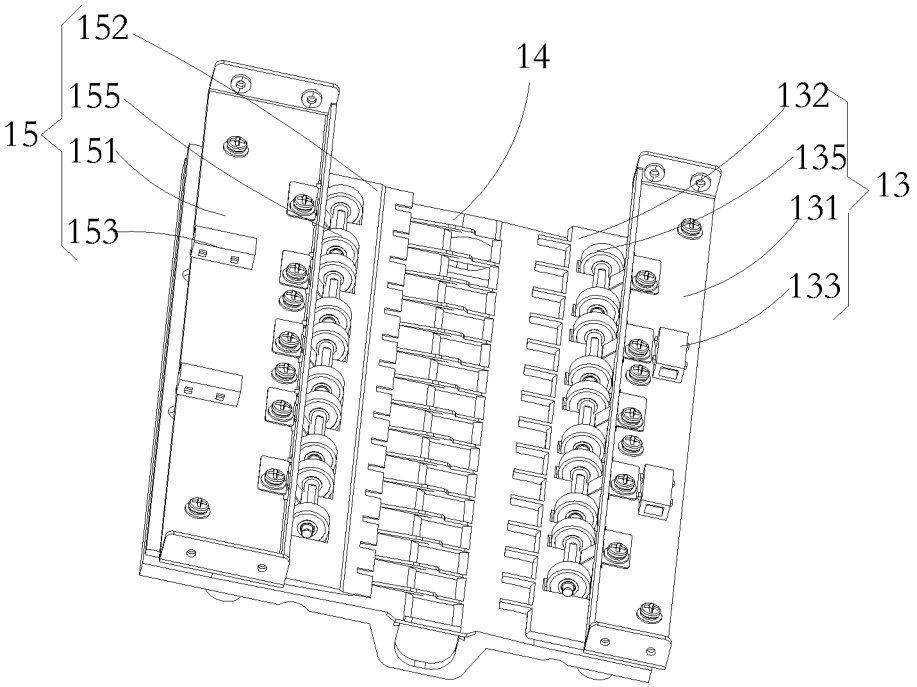
FIG. 9 is a schematic view showing the configuration of an upper passage of a transition passage mechanism in FIG. 2.
Figure 10:
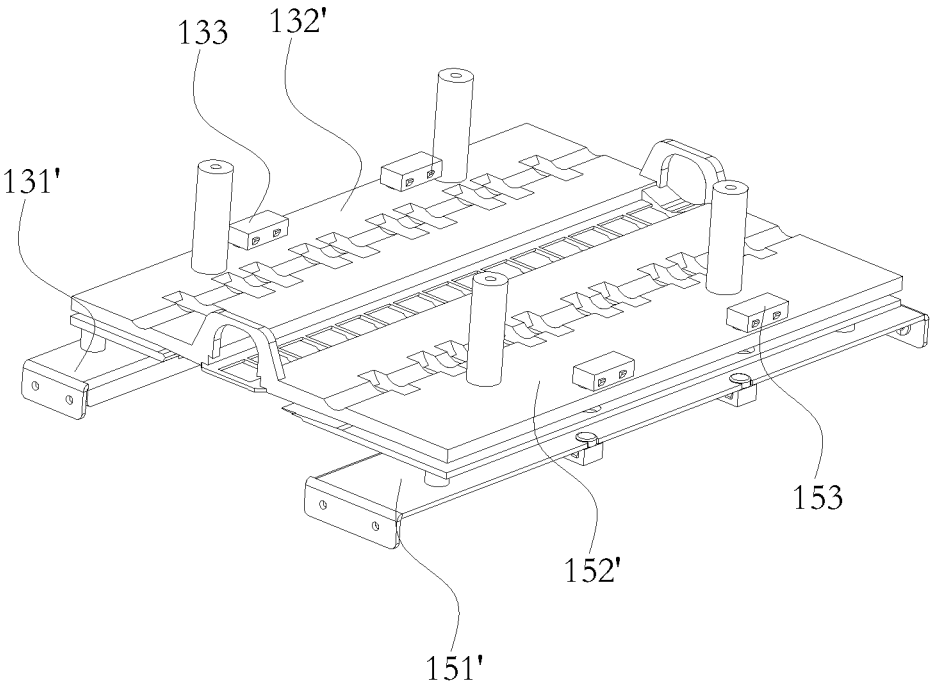
FIG. 10 a schematic view showing the configuration of a lower passage of the transitional passage mechanism in FIG. 2.

The sheet medium conveying passage in the flattening device is further illustrated with reference to FIGS. 8 to 10. The mounting frame 1 includes two lateral plates 11 and a bottom supporting plate 12. A front passage assembly 13, a lower passage 14 and a rear passage assembly 15 are arranged on the two lateral plates 11 and form transition with the sheet medium conveying passage. The lower passage 14 is arranged directly opposite to the sheet medium entrance 221 of the outer passage plate 22, and the sheet medium is controlled by the reversing mechanism 4 to be selectively introduced into the annular passage 2 or the lower passage plate 4 for conveying. Further, the front passage assembly 13 includes front passage plate holders 131 and 131' configured to support front passage plates 132 and 132', the front passage plates 132 and 132' are provided with a sensor 133 for detecting banknotes, a driving shaft 134 for conveying banknotes and at least one set of floating pressing rollers 135 corresponding to the driving shaft 134. The driving shaft 134 is rotatably arranged between the two lateral plates 11 of the mounting frame 1, and receives power from the driving device 5 through a gear 136. Similarly, the rear passage assembly 15 includes rear passage plate holders 151 and 151' configured to support rear passage plates 152 and 152', the rear passage plates 152 and 152' are provided with a sensor 153 for detecting banknotes, a driving shaft 154 for conveying banknotes and at least one set of floating pressing rollers 155 corresponding to the driving shaft 154. The driving shaft 154 is rotatably arranged between the two lateral plates 11 of the mounting frame 1, and receives power from the driving device 5 through a gear 156.

Figure 12:
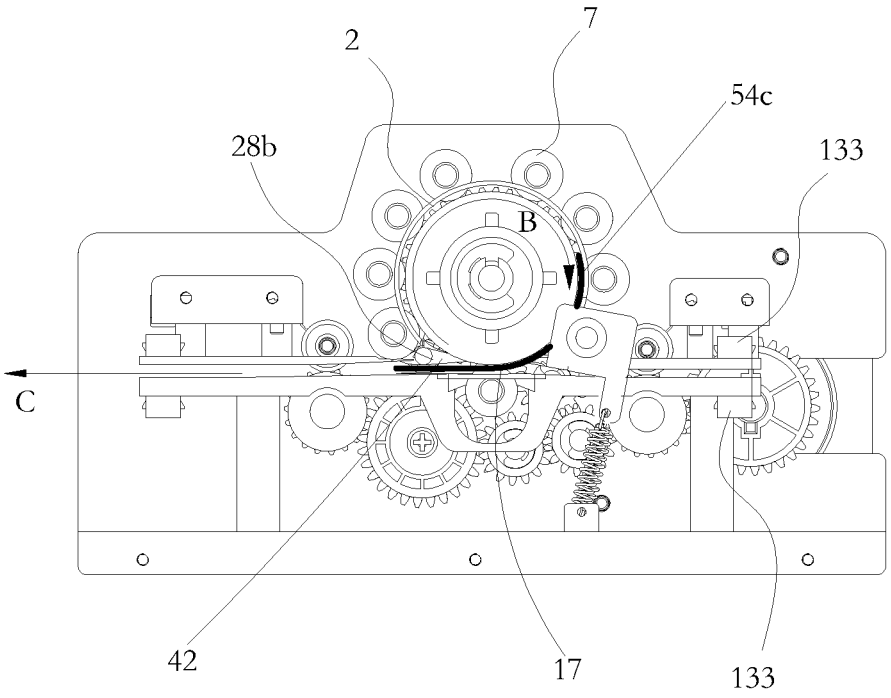
FIG. 12 is a schematic view showing that the curled banknote is heated and conveyed to a reversing mechanism in the flattening device.

The operation process of the sheet medium flattening device is illustrated hereinafter with reference to FIGS. 11 to 14. As shown in FIG. 11, in a case that a curled banknote 17, in accordance with a command, is discharged from the banknote storage box 63 for storing banknotes to the conveying passage to be conveyed toward the transitional front passage assembly 13 of the flattening device 60, when the curled banknote 17 moves in a direction A to a position of the sensor 133, the sensor 133 is triggered to send a signal to the control system, and the control system controls the reverser 413 to set the reversing block 412 at a position 28*a*, and at this time, the curled banknote 17 is guided by the reversing block 412 to enter the annular passage 2. Being clamped by the pinch roller 7 and the heated inner passage plate 21, the banknote rotates as the inner passage plate 21 rotates and moves in a direction B. When the curled banknote 17 completely enters the annular passage 2 (corresponding to a position 54*b* in the figure), the reversing block 412 rotates to a position 28*b*, as shown in FIG. 12.

Figure 13:
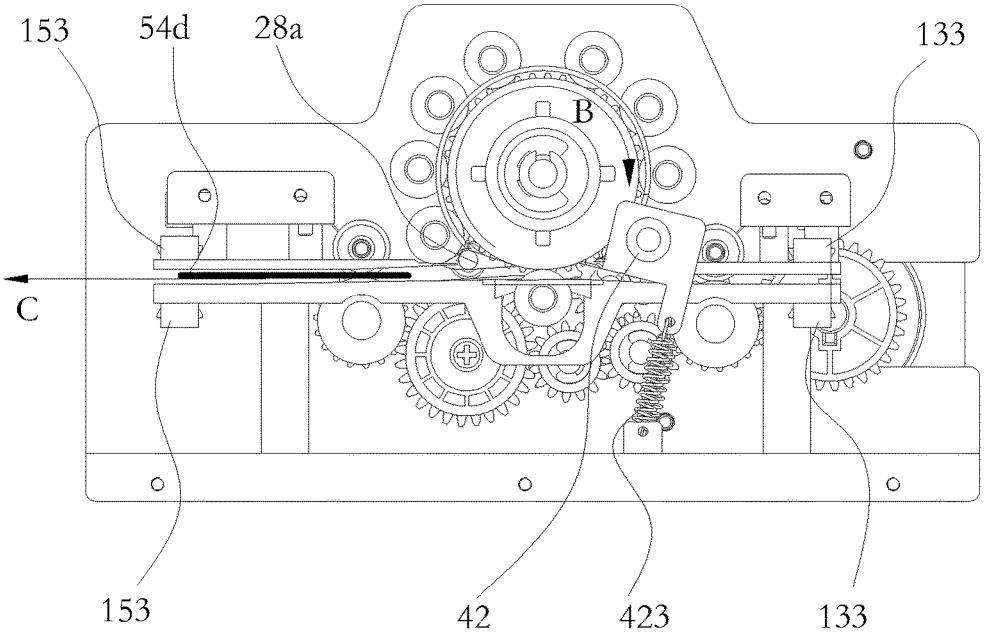
FIG. 13 is a schematic view showing the reversing mechanism when the heated and flattened banknote is discharged out of the flattening device.

When the curled banknote 17 is conveyed to a position Mc in the annular passage 2, the reversing block 412 is thrust aside due to an advancing inertia of the banknote 17, so that the banknote 17 enters the lower passage 14 and is guided into the rear passage plate 15 by the reversing mechanism 41 to move forward in a direction C. As shown in FIG. 13, when a front end of the flattened banknote 17 moves to a position 54*d*, the sensor 153 is triggered, and the reversing block 41 returns to the position 28*a*.

Figure 14:
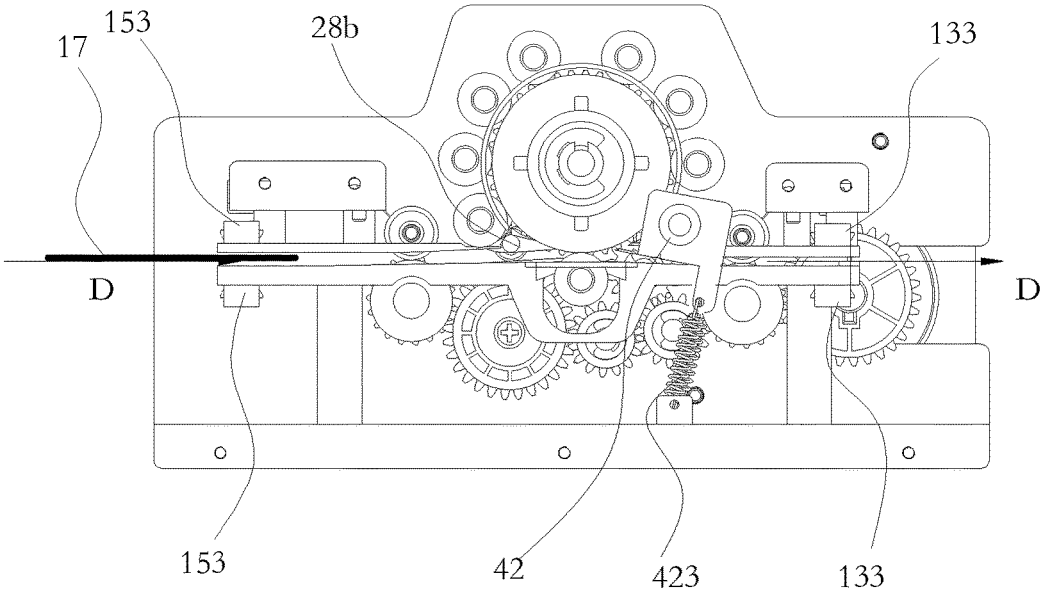
FIG. 14 is a schematic view showing the banknote conveying process when a normal banknote passes through the sheet medium flattening device.

Referring to FIG. 14, when a normal banknote 18 moves forward in a direction D, the reversing block 41 is at the position 28*b*, and the lower passage 14 is unblocked, so that the normal banknote 18 can directly move forward in the direction D in the rear passage assembly 15, the lower passage 14 and the front passage assembly 13 without being affected by the annular passage 2.

The above described embodiments are only preferable embodiments of the present application. It should be noted that, the above preferable embodiments should not be construed as limitations to the present application, and the scope of protection of the present application is defined by the claims. For those skilled in the art, several improvements and modifications can be made without departing from the spirit and scope of the present application, and these improvements and modifications should also be deemed to fall within the scope of protection of the present application.

What is claimed is:

1. A sheet medium flattening device, configured to be arranged in a sheet medium conveying passage and configured to flatten an inputted sheet medium, comprising:

a mounting frame configured to mount and support following components;

an annular passage, comprising an annular inner passage plate and an annular outer passage plate, wherein the inner passage plate has a hollow inner cavity, a heating module is arranged in the inner cavity, the heating module is configured to supply heat for the inner passage plate, the outer passage plate is an annular guiding plate surrounding the inner passage plate, and the outer passage plate is provided with a sheet medium entrance abuttingly joined with the sheet medium conveying passage;

at least one pinch roller arranged at an outer side of the annular guiding plate, wherein a hole slot is arranged in the annular guiding plate at a position corresponding to the pinch roller, and the pinch roller realizes clamping with the inner passage plate through the hole slot;

a reversing mechanism arranged at the sheet medium entrance and configured to selectively convey banknotes between the conveying passage and the annular passage of the flattening device;

a driving device configured to drive the inner passage plate to rotate; and a control system configured to control a temperature of the heating module and control a selectively switchover of the reversing mechanism.

2. The sheet medium flattening device according to claim 1, wherein the heating module comprises:

a heating body holder fixedly sleeved on a shaft, wherein the shaft is relatively fixedly mounted on the mounting frame; and at least one heating piece fixedly arranged on the heating body holder, and controlled by the control system to perform a heating operation.

3. The sheet medium flattening device according to claim 2, wherein the inner passage plate is rotatably arranged on the shaft by a rolling bearing to wrap and seal the heating piece, and the inner passage plate rotates by receiving power from the driving mechanism through a gear fixedly connected to the inner passage plate.

4. The sheet medium flattening device according to claim 2, wherein there are twelve heating pieces which uniformly surround the shaft and are fixed on the heating body holder through a limiting piece.

5. The sheet medium flattening device according to claim 1, wherein there are nine pinch rollers uniformly distributed on an outer surface of the annular guiding plate to surround and compress the inner passage plate.

6. The sheet medium flattening device according to claim 1, further comprising a front passage assembly, a lower passage and a rear passage assembly which form transition with the sheet medium conveying passage, wherein the lower passage is arranged directly opposite to the sheet medium entrance of the outer passage plate, and the sheet medium is controlled by the reversing mechanism to be selectively introduced into the annular passage or the lower passage to be conveyed.

7. The sheet medium flattening device according to claim 6, wherein the front passage assembly comprises a front passage plate holder configured to support a front passage plate, and the front passage plate is provided with a sensor for detecting banknotes, a driving shaft for conveying the banknotes, and at least one set of floating pressing rollers corresponding to the driving shaft.

8. The sheet medium flattening device according to claim 6, wherein the rear passage assembly comprises a rear passage plate holder configured to support a rear passage plate, and the rear passage plate is provided with a sensor for detecting banknotes, a driving shaft for conveying the banknotes, and at least one set of floating pressing rollers corresponding to the driving shaft.

9. A financial self-service equipment, comprising:

a banknote inlet/outlet configured to deposit and/or withdraw banknotes;

a banknote storage box configured to store and discharge the banknotes; and a banknote conveying passage configured to connect the banknote inlet/outlet and the banknote storage box and to convey the banknotes;

wherein the sheet medium flattening device according to claim 1 is arranged in the banknote conveying passage.

10. The financial self-service equipment according to claim 9, wherein the heating module comprises:

a heating body holder fixedly sleeved on a shaft, wherein the shaft is relatively fixedly mounted on the mounting frame; and at least one heating piece fixedly arranged on the heating body holder, and controlled by the control system to perform a heating operation.

11. The financial self-service equipment according to claim 10, wherein the inner passage plate is rotatably arranged on the shaft by a rolling bearing to wrap and seal the heating piece, and the inner passage plate rotates by receiving power from the driving mechanism through a gear fixedly connected to the inner passage plate.

12. The financial self-service equipment according to claim 10, wherein there are twelve heating pieces which uniformly surround the shaft and are fixed on the heating body holder through a limiting piece.

13. The financial self-service equipment according to claim 9, wherein there are nine pinch rollers uniformly distributed on an outer surface of the annular guiding plate to surround and compress the inner passage plate.

14. The financial self-service equipment according to claim 9, wherein the sheet medium flattening device further comprises a front passage assembly, a lower passage and a rear passage assembly which form transition with the sheet medium conveying passage, wherein the lower passage is arranged directly opposite to the sheet medium entrance of the outer passage plate, and the sheet medium is controlled by the reversing mechanism to be selectively introduced into the annular passage or the lower passage to be conveyed.

15. The financial self-service equipment according to claim 14, wherein the front passage assembly comprises a front passage plate holder configured to support a front passage plate, and the front passage plate is provided with a sensor for detecting banknotes, a driving shaft for conveying the banknotes, and at least one set of floating pressing rollers corresponding to the driving shaft.

16. The financial self-service equipment according to claim 14, wherein the rear passage assembly comprises a rear passage plate holder configured to support a rear passage plate, and the rear passage plate is provided with a sensor for detecting banknotes, a driving shaft for conveying the banknotes, and at least one set of floating pressing rollers corresponding to the driving shaft.

* * * * *